United States Patent [19]

Hubner

[11] 4,323,761

[45] Apr. 6, 1982

[54] RADIANT HEAT HAIR DRYER

[76] Inventor: Otto Hubner, Mauerkircher Strasse 199, Herzog Park, Munich (8000 Munchen 81), Fed. Rep. of Germany

[21] Appl. No.: 97,404

[22] Filed: Nov. 26, 1979

[51] Int. Cl.[3] ..... H05B 3/40; A45D 20/10

[52] U.S. Cl. ..... 219/377; 219/376; 219/364; 219/354; 219/369

[58] Field of Search ..... 219/377, 373, 370, 369, 219/354, 553, 347, 343; 34/96-99, 243 R, 3, 4; 132/7, 9 R

[56] References Cited

U.S. PATENT DOCUMENTS

| | | | |
|---|---|---|---|
| 1,106,975 | 8/1914 | Shaeffer | 219/375 |
| 2,026,991 | 1/1936 | Martin | 219/377 |
| 2,260,233 | 10/1941 | Ripley | 219/369 |
| 2,567,087 | 9/1951 | Sutton | 219/369 |
| 2,583,754 | 2/1952 | Theisen | 219/377 |
| 3,417,230 | 12/1968 | Millikan | 219/553 |
| 3,475,592 | 10/1969 | Berkl | 219/354 |
| 3,627,989 | 12/1971 | Heidler et al. | 219/354 |

FOREIGN PATENT DOCUMENTS

| | | | |
|---|---|---|---|
| 1371399 | 7/1964 | France | 219/369 |
| 924139 | 4/1963 | United Kingdom | 219/370 |

*Primary Examiner*—B. A. Reynolds
*Assistant Examiner*—Bernard Roskoski
*Attorney, Agent, or Firm*—Norman Lettvin

[57] ABSTRACT

A radiant heat hair dryer is provided, using a disc-shaped casing in which is mounted a ring-like, infra-red radiator, together with reflector means for directing the infra-red radiation through a grille-like member, that is shaped and constructed to support a small, inexpensive, motor for a flat air fan that directs a gentle flow of air through the same grille-like member providing only slight movement of the hair to avoid disarray of the hairdo while permitting the radiant heat to penetrate into the body of hair. The infra-red radiator includes an elongated, helical heating wire positioned in a ring-shaped, elongated, quartz tube whose ends are supported on a ceramic mount, with a secondary resistance heater carried in the ceramic mount for providing convection heat to ambient air. The resistance heater is advantageously employed to reduce current drawn by the fan's motor, so that an inexpensive, direct current, motor may be employed.

8 Claims, 6 Drawing Figures

FIG. 4
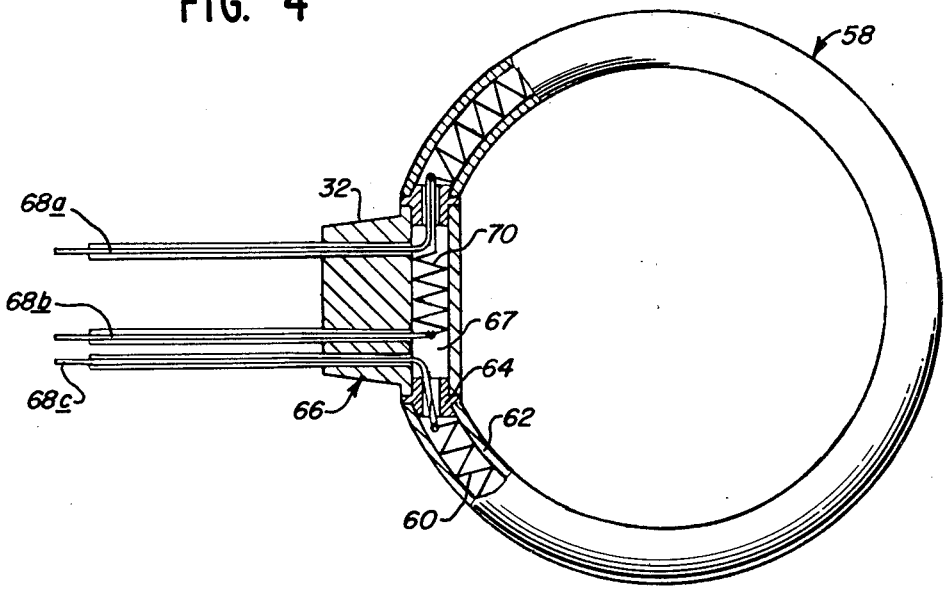
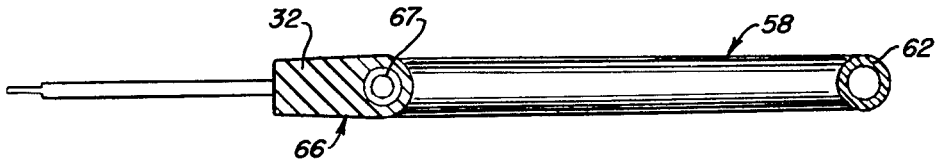
FIG. 5

RADIANT HEAT HAIR DRYER

FIELD OF THE INVENTION

This invention relates to radiant-heat hair dryers and to electrical heating combinations for use with such devices, and more particularly to hand-held, radiant-heat hair dryers that use a forced gentle flow of heated air to aid the radiant heat in effecting hair drying, with substantially little or no perturbation of the hair.

BRIEF SUMMARY OF THE BACKGROUND OF THE INVENTION

Hairdos which must be dried uniformly so that curls and waves are not dissolved, or disarrayed, by a concentrated, or forceful, air flow, require a special type of hair dryer.

Existing hair dryers are commonly known to provide drying through creation of a concentrated air flow of high blow, or velocity, through a relatively small blow opening, transporting heated air to reach the individual hairs in order to dry the hair in the shortest possible time. Such hair dryers are not acceptable for the stated purpose of drying hair curls and waves without effecting their disarray.

Other hair dryers have sought to meet the stated problem. Such other dryers use a blow opening of relatively large diameter, in an attempt to obtain a wide dispersal of the air flow. Such dryers are usually provided with an electromotor that, because of its size, awkwardly reaches completely out of the backside of the hair dryer, and with an air-driving propeller, or blower, positioned in the casing for blowing air over a wound heating wire for heating the air. One principal disadvantage of such a dryer, in addition to its large size making it difficult to manipulate, lies in the fact that it uses a wound heating wire as the source of convection heat. The radiant heat from such a heating wire is only superficial, and in order to obtain real drying, the blower must work at high speed and this produces the undesirable effect that the hairdo is subjected to turbulence from the moving air and thus is subject to destruction or disarray.

It is also known, generally, to use infra-red heat sources for hair drying. The infra-red heat sources, of known and marketed hair dryers, is a lamp. It is evident that the dimension of such an embodiment will be relatively large, because in order to obtain a satisfactory heating source, the body of the lamp, consisting of a coil in a vacuum space, must be made large. With such a source of infra-red heat, the instrument becomes difficult to handle, clumsy and top-heavy, and its use in a practical manual operation cannot be obtained. Furthermore, an instrument of this type has a maximum efficiency of only about 150 watts.

Other infra-red radiators are known in embodiments for the purpose of hair drying, such radiators being mounted on a stand so that they are used exclusively as standing equipment.

In connection with hair drying, it has been determined that infra-red radiation provides radiation heat which, through the process of absorption, transforms the radiation into heat at or adjacent the surface of the hair. The existence of the outer surface of the hair mass interferes with penetration of the infra-red heat through the thick mass of hair. To avoid absence of radiation heat below the outer surface of the hair mass, a slight, or soft, blowing of air in combination with infra-red radiation will move outer portions of hair gently, which permits the infra-red radiation to penetrate into the hair mass and to avoid radiation shadows. However, it has also been observed that the flow of room-temperature air through the means of an air blower can create an unpleasant cooling effect in wet or moist hair.

Therefore, a principal object of the present invention is to create an improved, infra-red, hair dryer for air-drying hairdos, which dryer avoids the above-mentioned disadvantages, and which will be used primarily as a hand-held instrument.

The infra-red hair dryer of this invention is particularly practical, being small and lightweight but having a relatively high heat output of up to 500 watts, producing little or no noise, having high efficiency, and in which the functional form also meets the requirements set forth for an electrical cosmetic instrument.

Another object of this invention is to provide a hand-held hair dryer wherein the primary source of drying is infra-red radiation, in combination with air-moving means for gently moving portions of the hair to permit penetration of radiant heat through the depth of the hair mass, and with means for convection heating the air being moved, so as to avoid unpleasant cooling effect of the moving air while also aiding, in some measure, the drying of the hair.

A further object of this invention, in connection with the use of both a primary infra-red radiation source and a secondary heater for modest heating of the air moved by a blower of the dryer, is to provide use of at least one of those heaters as a series resistor for economically integrating a low voltage, direct current, small motor, for driving the air wheel or blower of the air moving means of the hair dryer.

And still another object of this invention is to provide a combination of electrical elements which will produce an inexpensive construction, and an efficient assemblage of electrical components, for a hand-held hair dryer and having a capacity of providing up to 500 watts power.

To meet the foregoing objects there are provided molded, dished, parts that are joined together to provide a lightweight casing mounted at one end of a handgrip, the casing including a reflector therein, with an infra-red radiation source supported on the casing and arranged in a ring, in such a manner that the radiation of the infra-red radiator is amplified, or enhanced, by the reflector, and providing centrally of said casing a small, lightweight, electromotor that drives an air wheel, or propeller fan, that is positioned in a region between the reflector and the ring-like, infra-red source. The casing is provided, on its backside, with an air entry lattice, or grille, and on its frontside with a blow opening of large diameter, in which blow opening there is positioned a molded part that is shaped to integrally provide a front lattice, or grille, a central motor holder, and a rearwardly extending radiation-blocking sleeve positioned between the ring-like, infra-red source and the motor holder to provide therebetween a space or channel for flow of air therethrough.

Further objects and advantages will become known to a person skilled in the art from the following description of the invention having reference to the drawings of a preferred embodiment wherein:

BRIEF DESCRIPTION OF THE DRAWINGS

FIG. 4 is a plan view of a modified form of the heating means of the dryer of FIGS. 1–3;

FIG. 5 is a cross-sectional view of the heating means of FIG. 4 taken substantially on line 5—5 of FIG. 4.

DESCRIPTION OF THE PREFERRED EMBODIMENT

Figure 1:
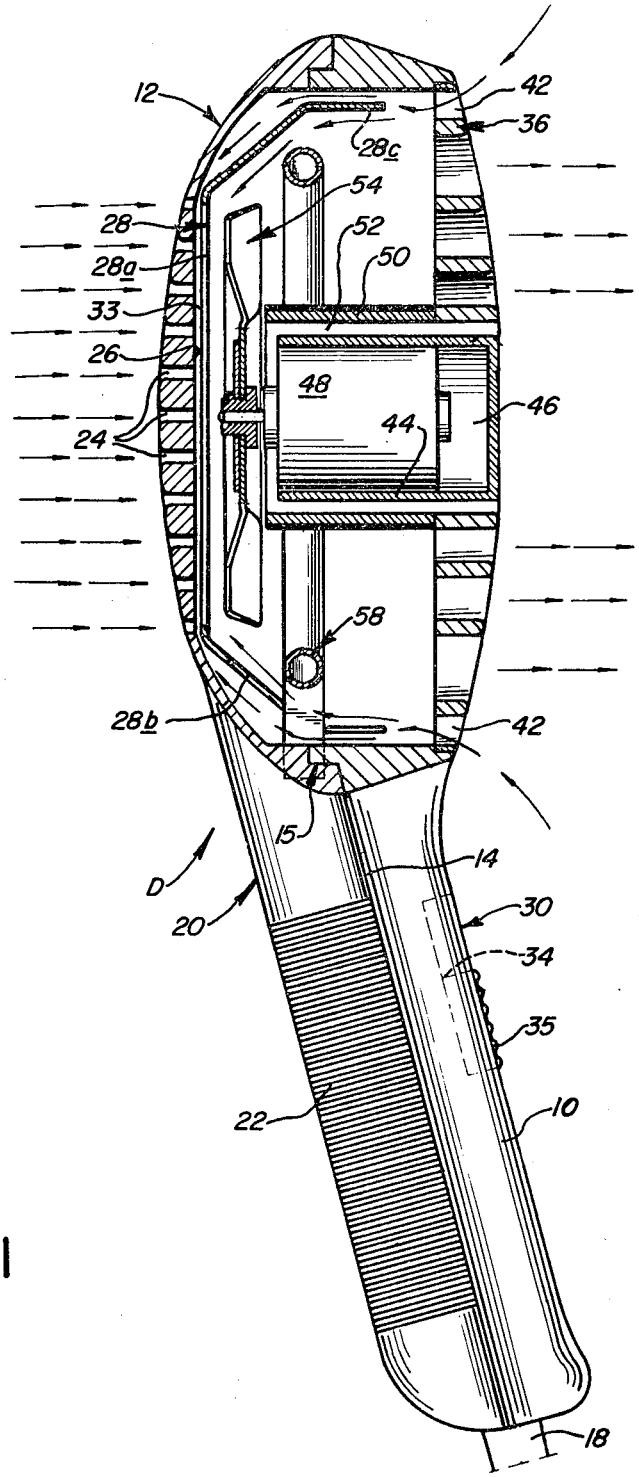
FIG. 1 is a side view of a hair dryer showing the handle thereof in elevation but with the casing portion shown in a cross-sectional view through a mediam line of the casing.
Figure 2:
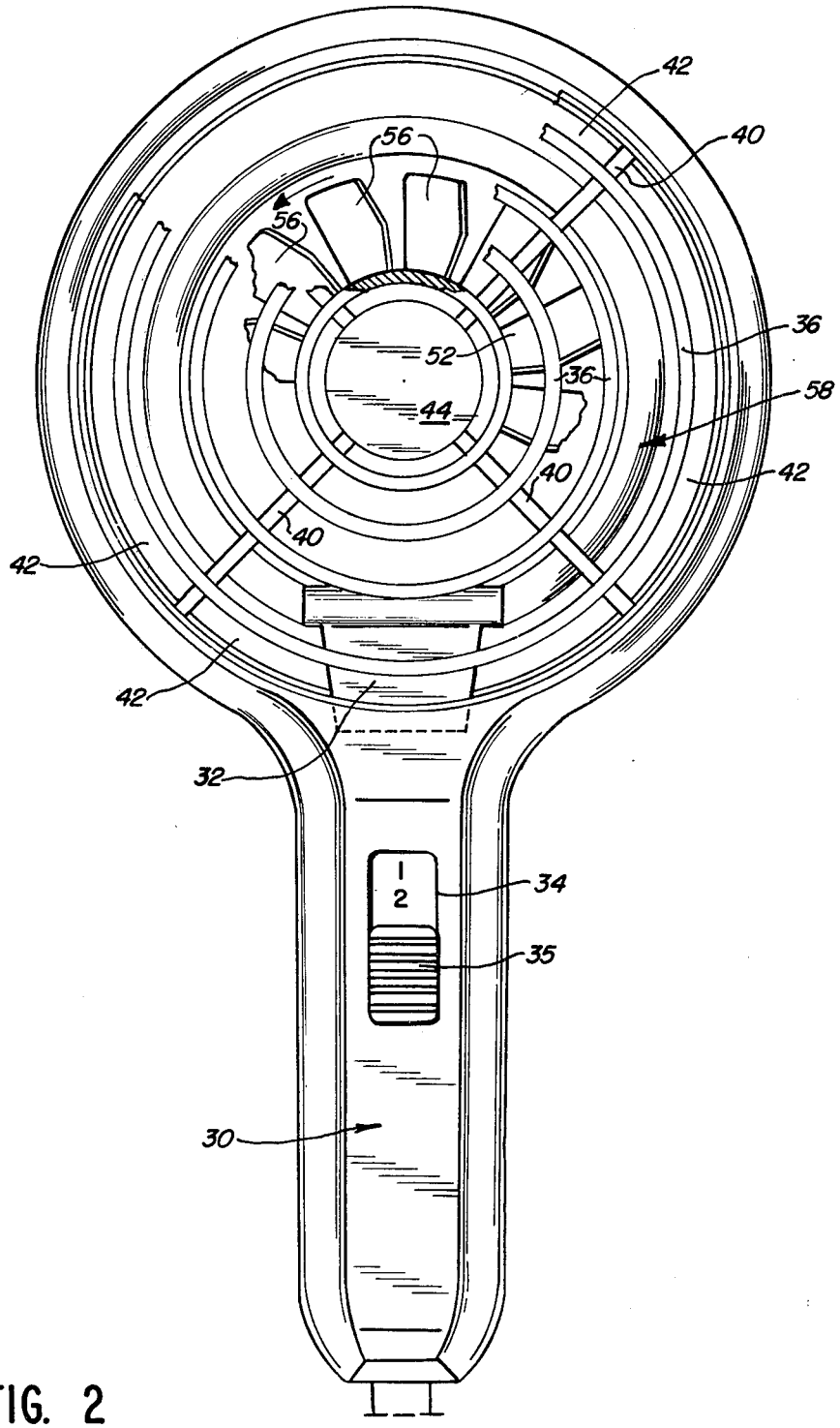
FIG. 2 is a front view of the dryer of FIG. 1 but with a portion of the front lattice broken away to show certain details.
Figure 3:
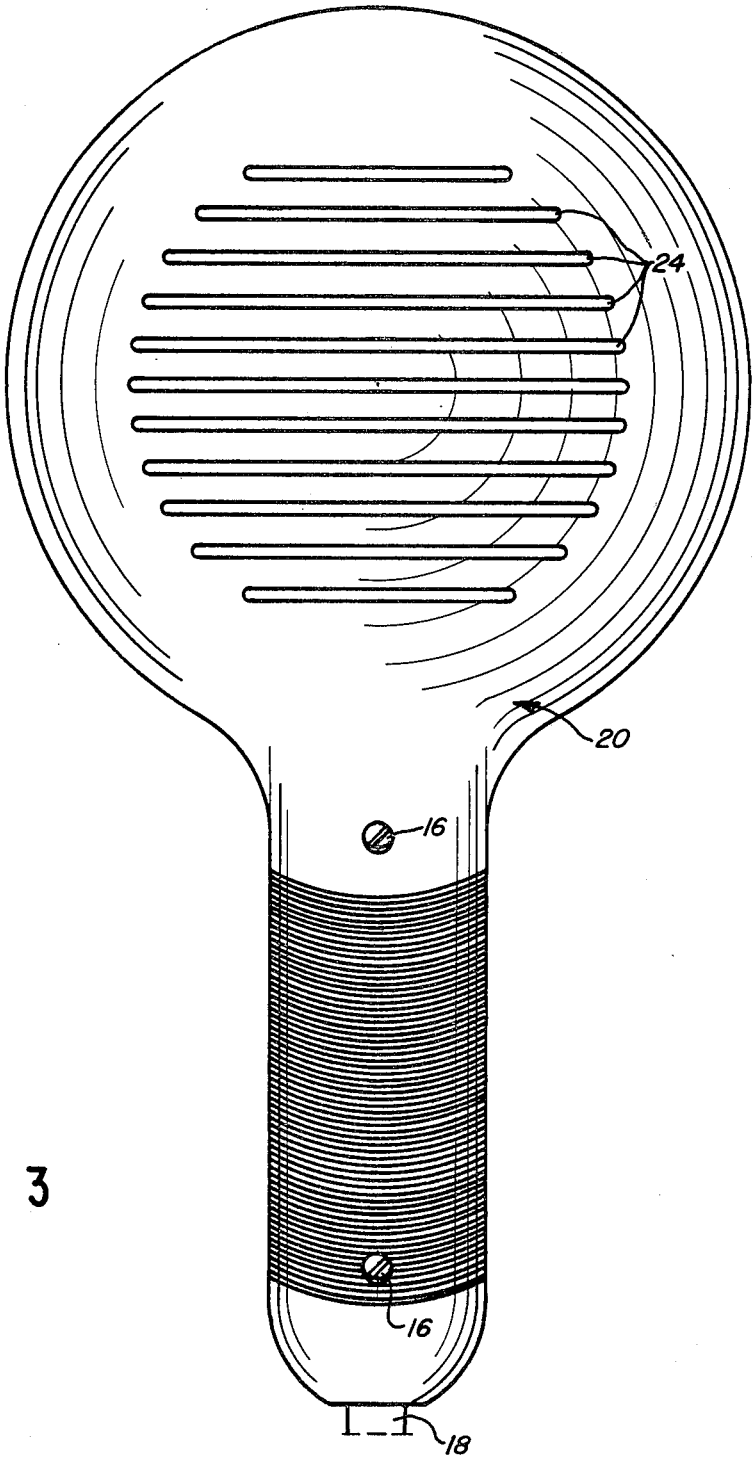
FIG. 3 is a rear elevational view of the dryer of FIG. 1.

Referring now to the drawings, a preferred form of the hair dryer is illustrated in FIGS. 1–3 generally as D. Its exterior configuration is defined by a pair of molded, plastic, dished, shell parts, hereinafter referred to as front and back shell parts, whose edges mate and with interfitting portions thereon, to provide an elongated hollow handle 10 and a disc-shaped casing, generally 12. The mating lines for the two molded parts is shown at 14 on the exterior of handle 10, and at the telescoping construction 15 of the casing portions seen in FIG. 1. The two shell parts can be secured together in any manner. In the preferred form, illustrated in FIG. 3, two screws 16 which screw into tapped bosses (not shown) on the interior of opposite, or front, shell part typically can be used to hold the shell parts together. A 3-conductor power supply cable 18, extending from the free end of handle 10, provides for electrical energization of the circuitry shown in FIG. 6. The other end of handle 10 merges with the disc-shaped casing 12.

The back shell 20 provides on the exterior thereof a ribbed hand grip section 22, and an air-entry grille, comprising a plurality of parallel slots 24, through the back wall of shell 20, in a slightly spherically-arched portion of casing 12. The interior of the slotted back wall is flat at 26 to substantially conform, in spaced relation, to the flat back wall of a reflector-shield 28. The circular inner periphery of the portion of back shell 20 that partially defines casing 12 is shouldered, or stepped, to define portions for telescoping connection at 15 with front shell 30.

The interior shape of back shell 20 and front shell 30, adjacent the junction of handle 10 and casing 12, will be provided with socket portions (not shown), to serve as a mounting recess for receiving therein the tapered stem 22 of the T-shaped ceramic element portion of the heat generating means shown in FIGS. 4 and 5. The reflector-shield 28 is supported in spaced relation to back shell 20 either through spacer means provided on back shell 20, or by supporting engagement of shield 28 on stem 32 of said T-shaped ceramic element. In either event, reflector-shield 28 lies in spaced relation to the inner surface of back shell 20 to provide an air flow passage 33 between back shell 20 and reflector-shield 28.

The front shell 30 has an opening 34 provided in the handle 10 in which is positioned a finger-actuated slide control, or switch, 35 which is constructed to be selectively moved to multiple positions including an "off" position and at least one "on" position. Multiple "on" positions, or settings, could include, as desired, different heat, or energy, output settings and/or motor speeds for moving air outwardly and forwardly of casing 12. In the construction shown in FIG. 6, there are two "on" positions for effecting different energy outputs. The casing portion of front shell 30 has secured therein, by cement or other means, a molded multiple purpose element 36 that provides an annular grille section defined by intersecting concentric ribs 38 and radial ribs 40 that bound a plurality of openings through which infra-red radiation, and air flow, projects outwardly and forwardly of casing 12 toward hair being dried, and peripheral openings 42 located circumferentially outwardly and adjacent the edge of casing 12, through which ambient air is drawn inwardly into the casing 12.

The multiple purpose element 36 is shaped to provide a centrally positioned, axially elongated, cup-shaped body 44, with a support rib 46 at the closed off inner end thereof, in which is positioned a lightweight, low voltage, DC motor 48. Element 36 is shaped to also provide an annular sleeve 50 that surrounds body 44 in spaced relation thereto provide an annular air flow passageway 52 therebetween. Element 36 is metal anodized on its multiple surfaces that are exposed to the radiant energy to provide for reduced absorption of radiant energy by element 36.

The motor 48 is operatively associated with an air wheel, or propeller fan, 54 that is generally flat as shown, and shaped to provide vanes 56 thereon for forcing and directing a flow of air outwardly through the grille section of element 36, and to cause cooling flow of air for motor 48 through air flow passageway 52.

Within casing 12 there are provided an infra-red radiator 58, the fan 54, and the reflector 28. The infra-red radiator 58 is in ring form, positioned concentric of both sleeve 50 and the cup-shaped body 44, and located in a plane between the axial ends of both said body 44 and sleeve 50. The reflector 28 is generally cup-shaped, with its open end facing in the direction toward the grille section of element 36, with the cup base **28*a* spaced from and parallel to the flat surface 26 of back shell 20, and with the walls of the cup including a frustoconical section 28*b* and cylindrical section 28*c* surrounding infra-red radiator 58 and spaced inwardly of the side walls of casing 12. The fan 54 is located in a plane spaced between the plane of the cup base 28*a* and the plane of the infra-red radiator 58**.

The infra-red radiator 58 includes a helical, electrically conductive and resistive, oxidizable, wire coil 60 positioned in a thin walled quartz torus, or ring 62, of relatively small diameter cross-section of the torus body. The excitation of the quartz crystals by the energization of wire coil 60 operates to effect discharge of radiant infra-red energy from radiator 58. The thin wall and small diameter of ring 62 provides a relatively small mass, so that the quartz ring 62 will heat up and cool down quickly, insuring quick response of the dryer when energized, and insuring quick dissipation of heat when the dryer is shut off.

The heating element details are best seen in FIGS. 3 and 4 and comprise the quartz torus 62 whose peripheral length is short of a full circle, joined at its ends through flanged sealing sleeves 64 to the ends of a hollow cross bar provided in the T-shaped ceramic element 66. The ceramic element 66 has a tapered mounting stem 32 previously referred to.

Figure 6:
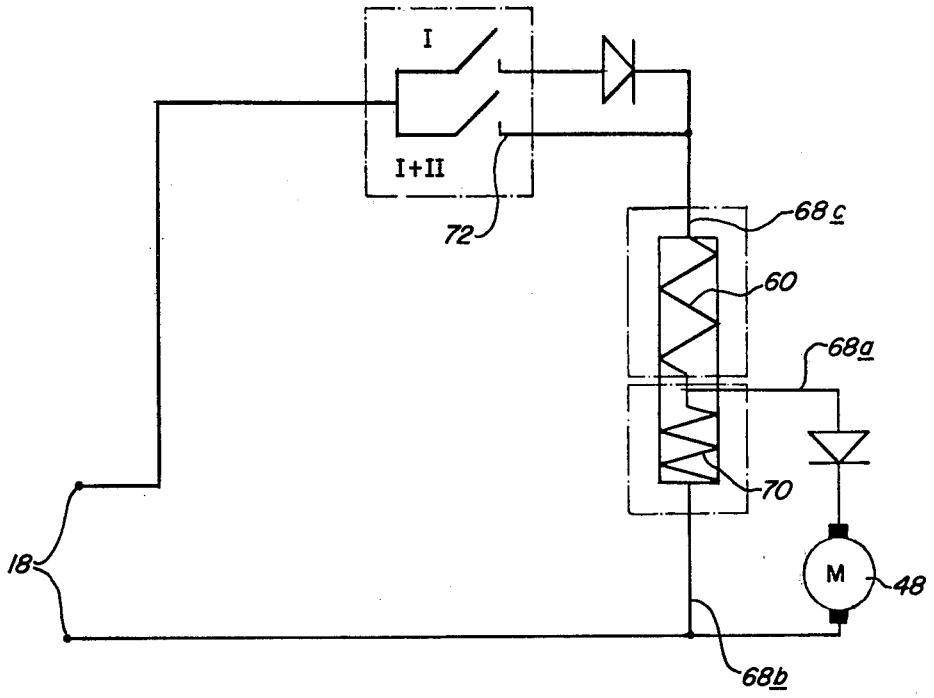
FIG. 6 is a schematic view of the electrical elements of a hair dryer embodying the heating means of FIGS. 4 and 5.

The electrical connections, seen in FIGS. 4 and 6, include connector **68*a* to one end of wire coil 60 of the infra-red radiation generator, connector 68*c* to the other end of wire coil 60, connector 68***a* to one end of conventional resistance coil heater 70, located in hollow space 67 of ceramic element 66 and conductor 68*b* to the other end of heater 70. The resistance heater 70 serves a double function of a series resistor for the low voltage, direct current motor 48.

An advantage of the construction shown in FIG. 4 is that the entire construction there shown may be handled as a unit, permitting ready replacement or exchange when necessary.

In the schematic FIG. 6, the switch operated by slide control 35 is provided with a contact in series with diode 72 so that the switching sequence obtained from slide control 35 is "off, I, and I+II", with diode 72 providing for energy output during only half-wave operation at position I and providing for increased energy output during full wave operation at position I+II.

The two ends of the torus quartz ring 62 are joined at the T-shaped ceramic element, not meeting end to end and forming a ring that is just short of a full circle (66) for a determinable section of the wound heating wire, along the width of the T-shaped ceramic element (66). The wire wound within the quartz ring serves for the production of infra-red radiation. This same wire, running along for a determinable section, the T-shaped ceramic element serves as a heating conductor and a resistor (70) for the electrical motor (48) which drives the fan (54). As a heating conductor, this section of the wire produces convection heat.

The electrical heating circuit and the motor operation circuit are housed compactly as a unit along the handgrip and rim of the dish of the hair dryer. This allows for simple electrical connection to ordinary household current without sophisticated adapters or other technical intervention.

The low voltage direct current motor (48) drives the air fan (54) so that the air flows favorably over the heated resistor (70) and produces a satisfactory warming of the flowing air and the hair.

There are essentially two compact electrical circuits presented. Referring to the schematic diagram (FIG. 6), the power supply (18) supplies an A.C. household voltage and current to the entire electrical system. This system allows for stepless rather than a step circuit for the heating and ventilation speed.

Tracing the conventional electrical current flow, the current leaves the power source traveling to the switch. If the operator chooses Mode I, the current will flow through a diode (1) for half-wave operation. If the operator wishes a full-wave operation, he switches to setting I and II (72).

After leaving the switch, the current flows through the quartz wound wire to produce infra-red radiation, and flows in series through the heat conductor (which serves as a resistor for the D.C. motor), and, back to the power source. A low voltage tap is provided to power the D.C. motor (48) which is connected to a second diode (8) for proper operation.

Thus the same current which produces infra-red radiation produces heat by convection through a heat conductor and powers a motor to run the air fan.

The electrical switch may be constructed with a delay element (relay) so that once the infra-red quartz ring radiator (58) is turned off, the air fan continues to function for a short additional period of time so as to cool the instrument.

The air flows through the back shell 20 across the air fan and out through the front shell 30 by way of its openings along the periphery 42. The direction of air flow includes a flow across the T-shaped ceramic element 66. In this way a soft convection current of air is created to flow gently over a wet hairdo.

In addition to the main flow of air from the rear to the front panel, there is a softer counter flow in through periphery openings 42 and across the reflector 28. The purpose of this air flow is to cool the air fan and motor casing, in order to increase protection against the heat created along the quartz ring 58. This dual circulation of air allows the gentle flow for purposes of hair dryer along with an internal air flow cooling system to maintain the integrity of the internal mechanism of the hair drying. As an additional cooling element, the shell and casing internally are coated with electrolytic oxidation coating of metal.

While one form of the invention has been described, it will be understood that the invention may be utilized in other forms and environments, so that the purpose of the appended claims is to cover all such forms of devices not disclosed but which embody the invention disclosed herein.

What is claimed is:

1. In a hand held hair dryer having means for directing air flow toward hair to be dried, the improvement comprising, in combination:

a casing having a forward grille-like support member adapted to be faced toward the hair to be dried;

an infra-red, ring-shaped, radiator in said casing spaced rearwardly of the grille-like member;

a motor carried on the grille-like member and extending rearwardly thereof centrally of said ring-shaped radiator;

shield means between the ring-shaped radiator and the motor for protecting the motor from the infra-red radiation;

radiation reflector means, including a portion spaced rearwardly of the ring-shaped radiator for directing reflected radiation toward and through the grille-like member;

a flat air propeller operatively associated with and driven by the motor and located spaced axially formed of the rearward portion of the reflector and rearward of the ring-shaped radiator, the propeller being operative to direct only a gentle flow of air through said grille toward the hair to be dried, to avoid destruction and disarray of the hairdo, but to move the top layers of hair sufficiently to permit radiation drying of the hair mass; and means for introducing cooling air into the casing to cool portions of the casing and the motor.

2. A hair dryer as in claim 1 including a resistance heater in the casing for convection heating the air that is directed outwardly through said grille-like member by said propeller.

3. A hair dryer as in claim 1 wherein the grille-like member is metal anodized to reduce its absorption of radiant energy from the infra-red radiator.

4. A hair dryer as in claim 1 including a grille-like wall bounding the side of the casing opposite for forward grille-like member to provide means for entry of air into the casing and against the reflector means to cool same.

5. A hair dryer as in claim 1 wherein the grille-like member is of greater area than the projected area of sweep of the propeller, whereby ambient air may be drawn into the casing, for cooling, through portions of the grille-like member adjacent the peripheral edges of said grille-like member.

6. A hair dryer as in claim 1 wherein a cooling flow passageway for the motor is provided adjacent the radially inner surfaces of the shield means.

7. A hair dryer as in claim 2 wherein the resistance heater is used to reduce the current drawn by the motor, and the motor being a lightweight, low voltage, direct current motor.

8. A hair dryer as in claim 1 wherein said infra-red radiator comprises:

an elongated helically coiled heating wire positioned in an elongated quartz tube, whereby when the heating wire is energized it causes the quartz tube to emit infra-red radiation for heating purposes.

* * * * *